United States Patent [19]

Grieger et al.

[11] 4,321,435

[45] Mar. 23, 1982

[54] FLUID ACTUATING DEVICE FOR AN ELECTRIC CIRCUIT BREAKER

[75] Inventors: Gerhard Grieger; Joaquin Bohrdt, both of Berlin, Fed. Rep. of Germany

[73] Assignee: Siemens Aktiengesellschaft, Munich, Fed. Rep. of Germany

[21] Appl. No.: 829,790

[22] Filed: Sep. 1, 1977

Related U.S. Application Data

[63] Continuation of Ser. No. 375,745, Jul. 2, 1973, abandoned.

[30] Foreign Application Priority Data

Jul. 13, 1972 [DE] Fed. Rep. of Germany ..... 2234811

[51] Int. Cl.[3] ..... F15B 13/04; F15B 15/17; H01H 35/38

[52] U.S. Cl. ..... 200/82 B; 91/27; 91/417 R

[58] Field of Search ..... 91/25, 26, 27, 416, 91/417 R, 235, 321, 20; 200/82 B, 82 R, 82 C

[56] References Cited

U.S. PATENT DOCUMENTS

| | | | |
|---|---|---|---|
| 1,005,132 | 10/1911 | Atwood | 91/27 X |
| 1,126,944 | 2/1915 | Bayles | 91/27 |
| 1,430,764 | 10/1922 | Smith | 91/27 |
| 2,266,415 | 12/1941 | Dinzl | 91/27 |
| 3,105,126 | 9/1963 | Peek et al. | 91/417 X |
| 3,110,783 | 11/1963 | Strom et al. | 200/82 B |
| 3,414,693 | 12/1968 | Watson et al. | 200/82 R |
| 3,416,406 | 12/1968 | McCreery | 91/27 |
| 3,450,003 | 6/1969 | Nightingale | 91/26 |
| 3,559,531 | 2/1971 | Leibfritz et al. | 91/26 |
| 3,832,502 | 8/1974 | Grieger et al. | 200/82 B |

FOREIGN PATENT DOCUMENTS

| | | | |
|---|---|---|---|
| 465429 | 2/1914 | France | 91/416 |
| 17327 | of 1914 | United Kingdom | 91 416/ |

*Primary Examiner*—Irwin C. Cohen
*Attorney, Agent, or Firm*—Kenyon & Kenyon

[57] ABSTRACT

An improved fluid actuating device for an electric switching apparatus such as a high-voltage power circuit breaker or the like includes an actuator for actuating the electric switching apparatus. The actuator has a cylinder and a differential piston movable in the cylinder between first and second end-positions corresponding to the open and closed positions of the switching apparatus. The differential piston has two end-faces for receiving fluid pressure force. One of the two end-faces has a surface area greater than the other one of the two end-faces. A high-pressure fluid supply supplies fluid to the two end-faces and a valve alternately interrupts and passes the fluid from the fluid supply to the one end-face whereby the differential piston is caused to move from the first end-position to the second end-position when the valve passes fluid to act upon the one end-face of the piston. Means are provided for reducing the quantity of the fluid supplied to the one end-face in the course of the movement of the differential piston to the second end-position from the first end-position and before the second end-position is reached.

8 Claims, 2 Drawing Figures

FLUID ACTUATING DEVICE FOR AN ELECTRIC CIRCUIT BREAKER

This is a continuation, of application Ser. No. 375,745, filed July 2, 1973, and now abandoned.

BACKGROUND OF THE INVENTION

The invention relates to a fluid actuating device for an electric circuit breaker, in particular a high-voltage power circuit breaker. The actuating device includes an actuator consisting of a differential piston and a cylinder. The differential piston is continuously exposed to the pressure of the pressure fluid on its small-area end-face and selectively, by means of a valve arrangement, on the large-area end-face.

A fluid actuating device of the foregoing type is disclosed, for example, in the copending U.S. patent application of Gerhard Grieger and Joaquin Bohrdt entitled: *FLUID ACTUATING DEVICE FOR AN ELECTRIC CIRCUIT BREAKER.*

Fluid actuating devices for electric circuit breakers, and in particular, for high-voltage power circuit breakers, must fulfill the purpose of moving the movable contacts as fast as possible and without delay in dependence on the control command for closing or opening the breaker. As for moving the movable contacts of modern, high-speed high-voltage power circuit breakers, which weigh several kilograms, an energy of several meter-kilograms is required for the drive, the differential pistons of fluid actuating devices must be transferred from their one end-position to the other end-position with considerable acceleration. To prevent rebound caused by impact, the piston motion must be decelerated in a suitable manner over a short stroke.

SUMMARY OF THE INVENTION

It is an object of the invention to provide an improved fluid actuating device wherein the piston is decelerated to prevent the undesired rebound or impact described above.

According to a feature of the fluid actuating device of the invention, the differential piston of the actuator reduces, in a self-acting manner, the supply of pressure fluid to the large-area end-face of this piston in the course of the piston motion caused by the action of the pressure on the large-area end-face before the piston reaches the end-position.

The fluid actuating device is especially suited for an electric switching apparatus such as a high-voltage power circuit breaker or the like. The fluid actuating device of the invention includes an actuator for actuating the electric switching apparatus. The actuator has a cylinder, and a differential piston is movable in the cylinder between first and second end-positions corresponding to the open and closed positions of the switching apparatus. The differential piston has two end-faces for receiving fluid pressure force. One of the two end-faces has a surface area greater than the other one of the two end-faces. A high-pressure fluid supply supplies fluid to the two end-faces. A valve alternately interrupts and passes the fluid from the fluid supply to the one end-face whereby the differential piston is caused to move from the first end-position to the second end-position when the valve means passes fluid to act upon the one end-face. Means are provided for reducing the quantity of the fluid supplied to the one end-face in the course of the movement of the differential piston to the second end-position from the first end-position and before said second end-position is reached.

In a preferred embodiment of the invention, the differential piston controls, as a function of its position, a valve which reroutes the supply of pressure fluid to the large-area end-face of the piston through an ancillary passage for throttling the flow of fluid thereto. The differential piston may form here the movable member of the valve and coact, in the manner of a slide valve, with a bore which conducts the pressure fluid and opens transversely into the cylinder space.

The ancillary passage can be in the form of a bypass which is connected parallel to the valve and whose cross-section is adjustable. Throttle means can be provided in the form of a screw as an adjusting element for changing the bypass cross-section. The invention allows the differential piston to be accelerated to high values, as is favorable for a rapid reversal of the breaker, without the result that the moving parts bounce or strike with a hard impact in the one end position which advantageously corresponds to the closed position of the electric circuit breaker.

Although the invention is illustrated and described herein as an improved fluid actuating device for an electric circuit breaker, it is nevertheless not intended to be limited to the details shown, since various modifications may be made therein within the scope and the range of the claims. The invention, however, together with additional objects and advantages will be best understood from the following description and in connection with the accompanying drawings.

DESCRIPTION OF THE PREFERRED EMBODIMENTS OF THE INVENTION

Figure 1:
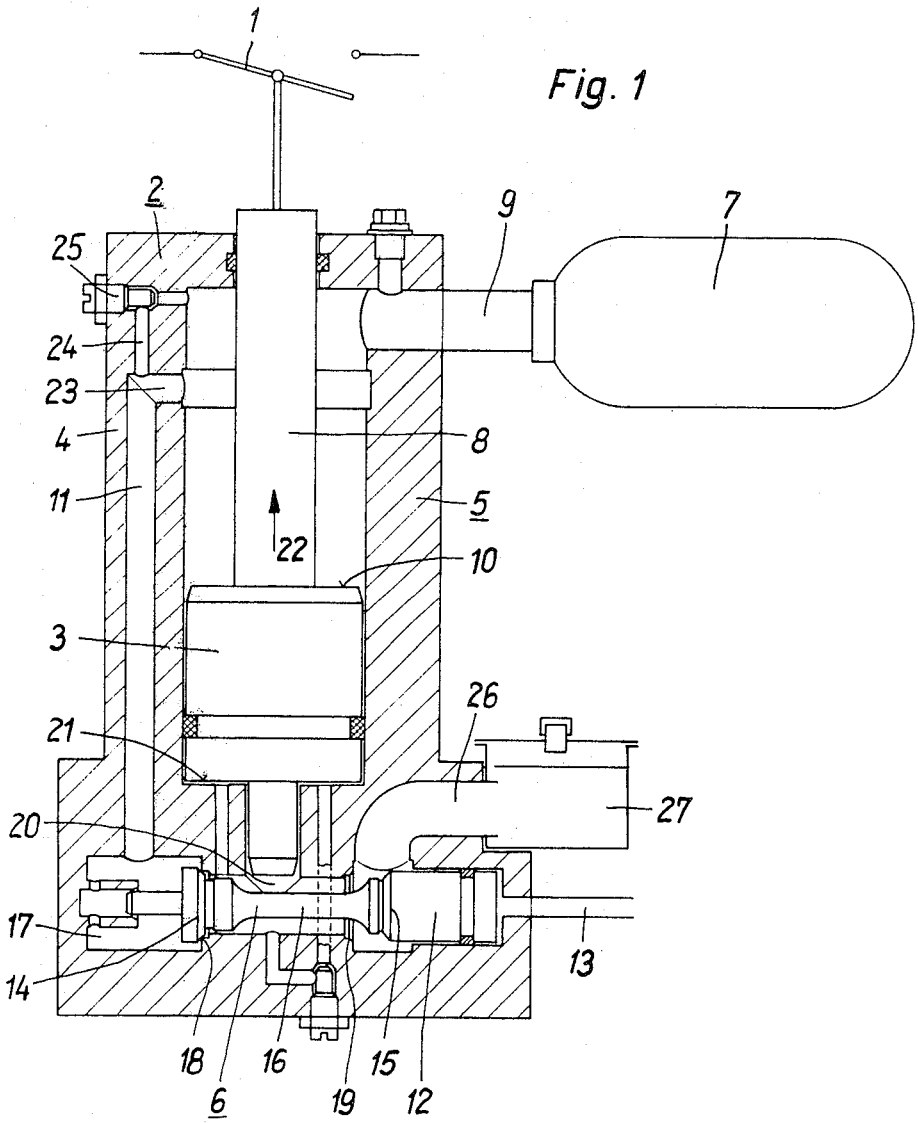
FIG. 1 is a schematic diagram, partially in section, of the fluid actuating device according to the invention. In this embodiment, the actuating device is shown adapted for actuating an electric circuit breaker. The differential piston of the actuator is shown in the position corresponding to the condition wherein the circuit breaker is opened.

FIG. 1 shows an electric power circuit breaker 1 which may, for example, be a blast-piston breaker with sulfur hexafluoride as the quenching medium and can be for operation at a voltage of 110 kV or more with a switching capacity of 5 GVA. The circuit breaker 1 is operated by a hydraulic actuating device 2. The hydraulic actuating device 2 includes an actuator 5 consisting of a differential piston 3 and a cylinder 4. Pressure can be alternately applied to the actuator 5 by means of the valve arrangement 6. The pressure fluid is taken from a fluid supply 7 wherein a predetermined pressure value is maintained by means of a pump (not shown).

The differential piston 3 of the actuator 5 is coupled with the movable contact of the breaker 1 by a piston rod 8.

The pressure fluid is fed from the reservoir 7 to the cylinder 4 of the actuator 5 through a line 9 in such a manner that the differential piston 3 is always exposed to the pressure of the pressure fluid on its small area end-face 10. From the line 9, a line 11 is supplied with pressure fluid and communicates with the valve arrangement 6. Valve means comprising the valve arrangement 6 is thus provided for alternately interrupting and passing fluid from the fluid supply 7 to the large area end-face 21 whereby the differential piston 3 is caused to move from the first end-position to the second end position when the valve arrangement 6 passes fluid to act on end-face 21 of the piston 3. The valve arrangement 6 is constructed as a reversing valve (three-way valve) and includes a differential piston 12. The piston 12 can be acted upon by pressure fluid from the line 11 and can be switched to one of two preferred positions as a function of pressure via a control line 13. For controlling the actuator 5, the differential piston 12 is connected with an inlet valve body 14 and an outlet valve body 15. The valve bodies 14 and 15 are rigidly connected with each other by a valve rod 16 and are coupled firmly with the differential piston 12.

Figure 2:
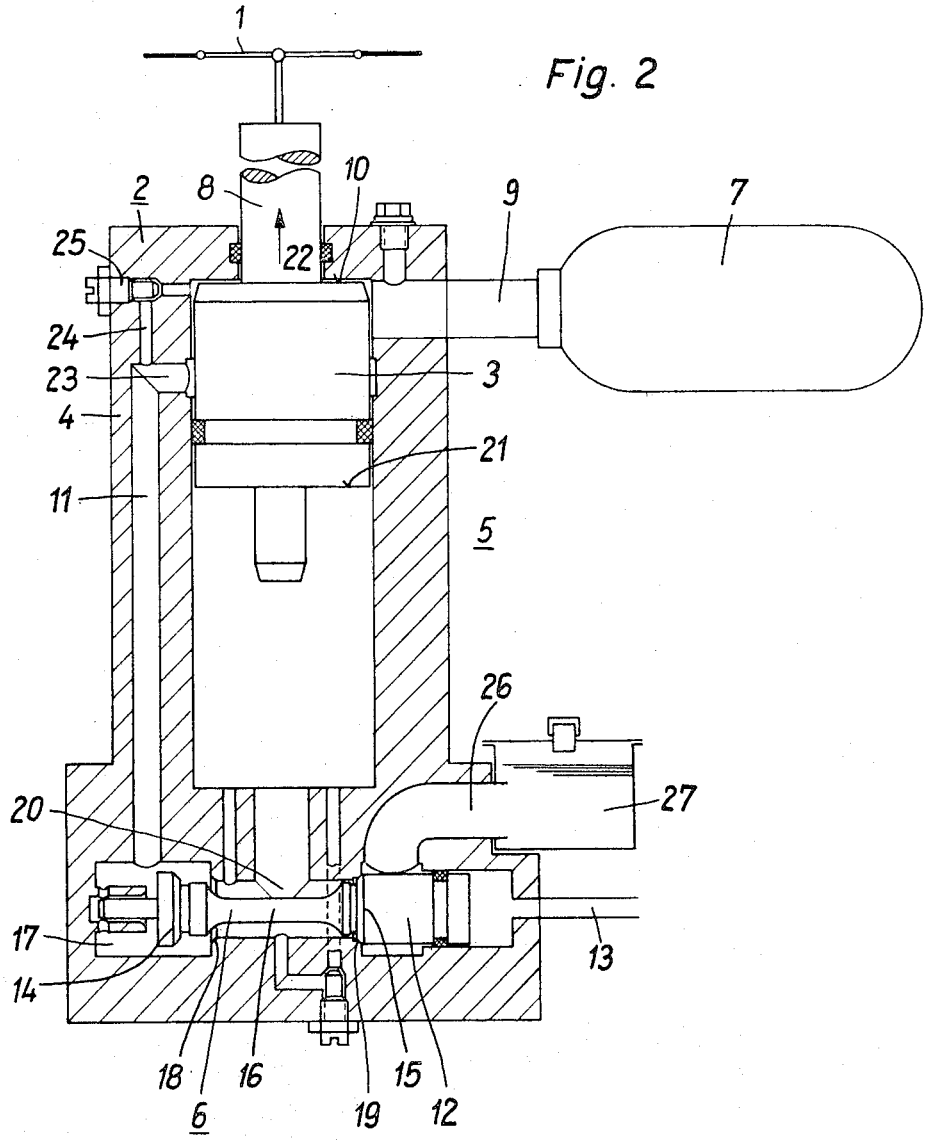
FIG. 2 is also a schematic diagram and shows the embodiment according to FIG. 1 wherein the differential piston is disposed corresponding to the condition of the circuit breaker in the closed position.

To close the power circuit breaker 1, fluid under pressure is admitted to the line 13, so that the differential piston 12 is brought into the position shown in FIG. 2. In this process the inlet valve body 14 is pushed into the space 17 carrying pressure fluid and the associated valve seat 18 is opened. At the same time the outlet valve body 15 is pressed against its seat 19. The pressure fluid supplied from the line 11 drives through a cylinder bore 20 the large-area end-face 21 of the differential piston 3 in the direction of the arrow 22. In the course of its movement caused by the action of the pressure on the large-area end-face 21, the differential piston 3, acting as the gate of a slide valve, closes a bore 23 which opens transversely into the cylinder space. The bore 23 conducts pressure liquid to the line 11. Together with the differential piston 3, the bore 23 constitutes a valve which is closed when the small-area end-face 10 has passed the bore 23 in the direction of the arrow. After this valve is closed, the supply of the pressure fluid is rerouted to the large-area end-face 21 by means of an ancillary passage formed by a bypass 24 which is connected parallel to the valve formed by the bore 23 and the differential piston 3. The bore 23 can be considered as a primary passage.

The primary passage and ancillary passage form part of passage means communicating with the portion of the cylinder above the small-area end-face 10 for directing fluid from this portion of the cylinder to the large area end-face 21.

The bypass contains throttle means in the form of a screw 25. By turning the screw 25, the effective cross-section of the bypass 24 can be adjusted and the damping of the piston thereby influenced.

The operation of this damping arrangement in the described configuration will now be described. In closing the circuit breaker, the motion of the differential piston 3 in the direction of the arrow 22 is damped via the bypass 24. Because of the fact that the differential piston is continuously subjected on its small-area end-face 10 to the pressure of the pressure fluid via the line 9, which leads directly to the pressure supply 7, the differential piston 3 starts to move, when the direction of the valve arrangement 6 is reversed in response to a breaker open command, against the direction of the arrow 22, uninfluenced by the damping arrangement of the bypass 24 and throttle means 25. The pressure medium present on the large-area end-face 21 of the differential piston 3 is conducted through the bore 20 and from there through the outlet valve 15 to a line 26 which leads to a low-pressure tank 27 for pressure fluid.

What is claimed is:

1. Fluid actuating device for an electric switching apparatus such as a high-voltage power circuit breaker or the like, said switching apparatus comprising first and second contacts at least one of which is movable and said fluid actuating device comprising an actuator for actuating the electric switching apparatus; said actuator including a cylinder, and a differential piston movable in said cylinder between first and second end-positions corresponding to the open and closed positions of said first and second contacts, said differential piston having two end-faces for receiving fluid pressure force; one of said two end-faces having a surface area greater than the other one of said two end-faces, high-pressure supply means for supplying fluid to said two end-faces; valve means for alternately interrupting and passing the fluid from said fluid supply means to said one end-face whereby said differential piston is caused to move from said first end-position to said second end-position when said valve means passes fluid to act upon said one end-face, means for reducing the volumetric flow-rate of the fluid supplied to said one end-face to a predetermined level in the course of the movement of said differential piston to said second end-position from said first end-position and before said second end-position is reached so as to cause the fluid to be continuously supplied to said one end-face at said predetermined level at the pressure of said high-pressure supply means until said end-position is reached and means for coupling said differential piston to said movable contact so as to cause said movable contact to move from a position whereat said first and second contacts are open to a position whereat said first and second contacts are closed as said piston moves from said first end-position to said second end-position.

2. The fluid actuating device of claim 1, said last-mentioned means comprising passage means communicating with the portion of said cylinder above said other one of said end-faces for directing fluid from said portion to said one end-face, said passage means being arranged at said portion of said cylinder so as to cause said piston to control the passage of fluid through said passage means in dependence upon the position of said piston between said two end-positions.

3. The fluid actuating device of claim 2, said passage means comprising primary and ancillary passages communicating with said portion of said cylinder at respective locations thereof, said locations being determined so as to cause said piston to interrupt the flow of fluid through said primary passage in the course of said movement and to cause the fluid in said portion of said cylinder to be directed only through said ancillary passage as said piston moves ever closer to said second end-position thereby throttling the flow of fluid to said one end-face.

4. The fluid actuating device of claim 3 comprising throttle means serially connected into said ancillary passage for adjusting the flow of fluid therethrough.

5. The fluid actuating device of claim 4, said primary passage means being a bore opening transversely into said portion of said cylinder for conducting fluid therefrom whereby said piston and said bore coact to constitute a valve, the piston acting as the movable member of said valve.

6. The fluid actuating device of claim 3, said ancillary passage being a bypass connected in parallel with said primary passage, and throttle means serially connected into said passage for adjusting the cross-section of said bypass.

7. The fluid actuating device of claim 6, said throttle means being a screw adjustably penetrating said bypass for adjusting the cross-section thereof.

8. A fluid actuating device for actuating switching apparatus, including at least two contacts, one of which is movable, comprising:

(a) an actuator for bringing said two contacts together comprising:
  (i) a cylinder;
  (ii) a differential piston disposed in said cylinder, said piston having first and second end faces, said first end face having an area greater than said second end face, said piston movable in said cylinder between first and second end positions corresponding to the open and closed positions of said contacts; and
  (iii) a piston rod rigidly connecting said piston to one contact;

(b) high pressure fluid supply means;

(c) means for continuously supplying fluid at high pressure from said supply means to said second end face;

(d) valve means for selectively supplying fluid from said supply means to said first end face to move said piston from said first to said second end position, said fluid, when supplied, supplied to the full area of said first end face over its full range of movement from said first to said second end position; and (e) means for reducing the volumetric flow rate of the fluid supplied to said first end to a fixed predetermined level and at the pressure of said supply means before said second end position is reached when moving from said first to second end position, said level being maintained until said second end position is reached whereby said contacts will be brought together quickly with a deceleration prior to contact but with sufficient flow and pressure to prevent rebound on contact.

* * * * *